United States Patent [19]

Creamer

[11] 3,961,710

[45] June 8, 1976

[54] CLOTHES HANGER SUPPORT AND STORAGE APPARATUS

[76] Inventor: Adelene B. Creamer, 137 Palmer Ave., Mountain View, Calif. 94040

[22] Filed: Mar. 13, 1974

[21] Appl. No.: 443,269

[52] U.S. Cl. ..... 211/49 R; 211/123

[51] Int. Cl.[2] ..... B65B 17/02

[58] Field of Search ..... 211/49, 49 D, 59, 105.1, 211/183, 123, 7; 224/42.1 CA, 42.1 C, 42.46 A, 42.45 A

[56] References Cited

UNITED STATES PATENTS

| | | | |
|---|---|---|---|
| 1,421,614 | 7/1922 | Taubman | 211/94 X |
| 2,536,293 | 1/1951 | Koses | 224/42.45 A |
| 2,583,806 | 1/1952 | Batzle | 224/42.45 A |
| 2,918,174 | 12/1959 | Tabbi | 211/49 R |
| 3,007,582 | 11/1961 | Lindstrom | 211/87 |
| 3,471,031 | 10/1969 | Coplan | 211/86 |
| 3,543,941 | 12/1970 | Gorman | 211/4 |
| 3,759,398 | 9/1973 | Romney | 211/47 |
| 3,814,008 | 6/1974 | Beshara | 211/49 R |

*Primary Examiner*—Francis K. Zugel
*Attorney, Agent, or Firm*—Limbach, Limbach & Sutton

[57] ABSTRACT

A clothes hanger support and storage assembly for conventional type wire clothes hangers is described and having an elongate base support member to which are connected a hanger support rod and a hanger retaining member such that clothes hangers positioned with their head portions on the hanger support rod contact the hanger retaining member and are prevented from tangling.

1 Claim, 5 Drawing Figures

FIG. 1
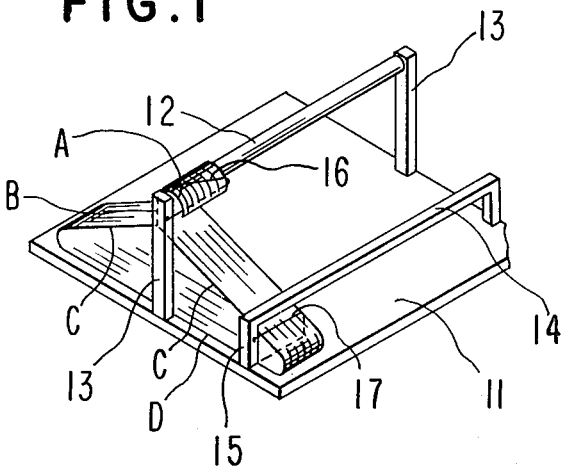
FIG. 2
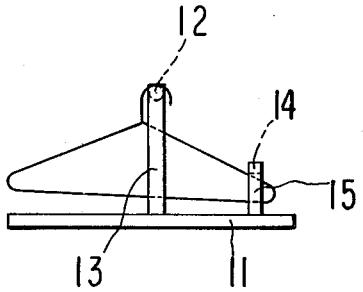
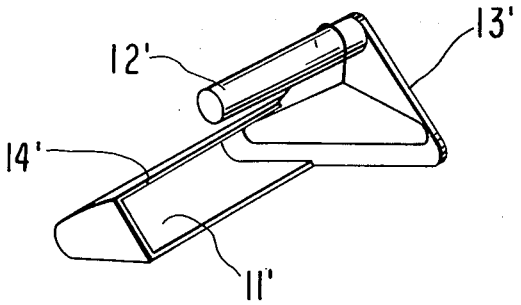
FIG. 3
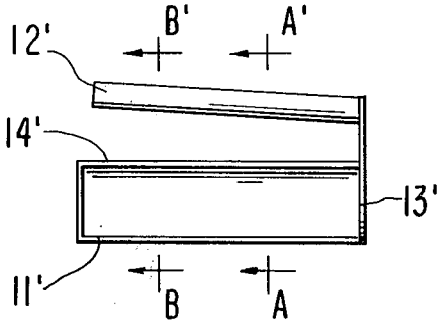
FIG. 4
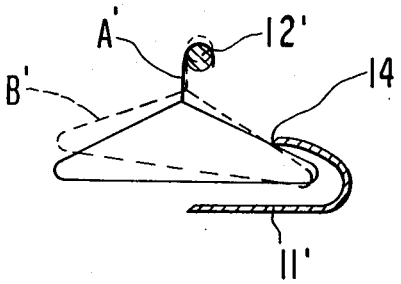
FIG. 5

CLOTHES HANGER SUPPORT AND STORAGE APPARATUS

BACKGROUND OF THE INVENTION

The present invention relates to an apparatus for supporting and storing a number of conventional wire clothes hangers in a compacted, untangled state which allows removal from the apparatus of one or more hangers at a time.

Tangled clothes hangers are a nuisance to everyone and especially to persons, such as the ironing housewife, who routinely must handle a great number of hangers. Any time hangers merely hang from a single rod they will rotate sufficiently to tangle or to be in a position where one of the coat hangers upon removal will tangle with the other hangers. At present, no satisfactory apparatus has been devised to maintain the number of hangers in a state that will keep them from tangling. It is the object of the present invention to provide such an apparatus.

SUMMARY OF THE INVENTION

Broadly stated the present invention, to be described in greater detail below, is directed to a hanger storage and support assembly having a base support member, a hanger support rod connected to the base support member and spaced therefrom for supporting clothes hangers by their head portion above the base support member, and a hanger retaining member also spaced above the base support member and laterally of the hanger support rod but closer to the base support member than the arm portion at that lateral offset distance of a clothes hanger normally hanging from a single rod such that the hanger retaining member contacts the arm portion of the hanger thereby preventing rotation of the hanger.

The hanger retaining member can take the form of a second rod or as a surface portion connected to the base member.

In accordance with another aspect of the present invention, the hanger support rod is inclined at a slight angle to the plane of the base support member so that clothes hangers supported on the support rod are urged along the hanger support rod toward the end thereof closest to the base support member.

In accordance with still another aspect of the present invention, elastic retaining means are provided for pulling the coat hangers along the hanger support rod toward one end thereof to help hold the hangers in a tight pack and preventing tangling during movement of the entire assembly from one location to another location.

These and other features and advantages of the present invention will become more apparent from a perusal of the following specification taken in connection with the accompanying drawings wherein:

FIG. 1 is a perspective view of one embodiment of the present invention;

FIG. 2 is an end elevational view of the structure shown in FIG. 1;

FIG. 3 is a perspective view of another embodiment of the present invention;

FIG. 4 is a front elevational view of the sturcture shown in FIG. 3; and

FIG. 5 is a diagrammatic view illustrating the hanging position of coat hangers at two spaced apart locations along the hanger support rod shown in FIG. 4.

DESCRIPTION OF THE PREFERRED EMBODIMENTS

Referring now to the drawings, the clothes hanger support assembly of the present invention is illustrated for support and storage of conventional clothes hangers which have a hanger head portion A, a neck portion B, a pair of arm portions C each connected at one end to the neck portion, and a base portion D connected between the lower ends of the arm portions remote from the neck portion. These coat hangers are typically made of wire. The present invention also is applicable to clothes hangers which do not have a base portion. Typically these hangers include the same head and neck portions made of wire, but the arm portions are made of a single arcuate piece of wood.

Referring now to FIGS. 1 and 2, the hanger support and storage assembly there illustrated includes an elongate base member 11 in the form of a flat plate or board. A hanger support rod 12 in the form of a tubular or solid rod member is connected to the base support member and spaced thereabove by a pair of spaced apart upright support members 13. The base member, support rod and support members can be of any appropriate material such as wood, metal or plastic. Certain of the members may be integral with one another so the manner in which the different members are connected together depends upon the selection of material and is not a distinct part of the present invention.

The hanger support rod 12 is spaced above the base support member by a distance greater than the distance from the top of the head portion of a coat hanger to the base portion of the coat hanger to allow the coat hanger to remain out of contact with the base member when the coat hanger is tilted from a normal vertical hanging position by reason of the hanger retaining member to be described below.

The assembly includes a hanger retaining member 14, also in the form of a rod and shown of rectangular cross-section, supported above the base support member and connected thereto by a pair of spaced apart upright members 15. The hanger retaining member 14 is spaced laterally from the hanger support rod 12 by a distance less than the lateral distance between the neck B and the remote end of an arm C of a conventional coat hanger so that the retaining member 14 can contact one of the arm portions of the hangers hung on the support rod 12.

The hanger retaining member 14 is spaced closer to the base support member 11 than the hanger support rod 12 by a distance greater than the vertical distance from the top of the hanger head portion A to a point on the hanger arm portion spaced laterally from the top of the head portion by a distance equal to the lateral spacing between the hanger support rod and the hanger retaining member. It will be appreciated that the greater the lateral spacing between the hanger support rod and the hanger retaining member, the greater the vertical spacing between these members will have to be so that hangers hung vertically with their heads on the hanger support rod 12 will have an arm portion C in contact with the hanger retaining member. Thus, the clothes hangers hung in the assembly will be rotated slightly from the normal hanging position of the coat hanger were they just in contact with the hanger support rod. The two points of contact, i.e. with the hanger support rod and the hanger retaining member prevent the coat hangers from rotating and tangling.

The embodiment illustrated in FIGS. 1 and 2 provides a generally upright support and storage assembly for hangers and permits easy transport of stored hangers from a storage location such as on the shelf of a closet to the point of use such as adjacent to the ironing board.

To aid in the transportability of the hanger assembly with the hangers thereon, elastic loops 16 and 17 are connected near one end of the support rod 12 and retaining member 14, respectively, for looping over the heads and ends, respectively, of hangers on the assembly.

If so desired the assembly shown in FIGS. 1 and 2 can include provision for clipping the assembly onto an ironing board where it will hold the hangers for use.

The structure shown in FIGS. 1 and 2 can be easily transported by gripping the hanger support rod 12 and lifting the assembly.

Referring now to FIGS. 3–5, there is shown an alternative embodiment of the present invention wherein similar parts are designated with similar reference numerals. In the embodiment shown in FIGS. 3–5, the base support member 11′ and the hanger retaining member 14′ are formed from a continuous panel which is curved around the end of the hanging coat hangers. This panel is connected at one end to a vertical plate 13′ to which the hanger support rod 12′ is in turn connected.

In the particular embodiment illustrated in FIGS. 3–5, the hanger support rod makes an acute angle, with the plane of the base support member 11′ whereby when the big support member is positioned on a horizontal surface, clothes hangers positioned on the hanger support rod 12′ are urged along the rod 12′ toward the panel 13′ where the rod 12′ is closest to the base support member 11′. This angle is sufficiently small so that jiggling action of the assembly during transport is not sufficient to cause the heads of coat hangers to ride over one another on the hanger support rod. The particular most appropriate angle will depend upon the size of the hanger support rod and the materials from which the assembly is made which determine the amount of friction between coat hangers positioned on the assembly.

While both the hanger support rod and the hanger retaining member can be inclined at the same angle to the base support member, one embodiment of the present invention includes an angled hanger support rod but a horizontal or non-angled hanger retaining member which results in a different elevation from the base support member of the remote end of the hanger arm portion which is on the opposite side of the support rod from the retaining member.

This feature of the invention is illustrated in FIG. 5 which shows two different positions for coat hangers in vertical planes AA and BB along the hanger support rod 12′ in FIG. 4.

Where the hanger support rod 12′ is inclined at an angle to the base member 11′ as shown in the embodiment of FIGS. 3–5, the hanger support rod can include at its top surface a series of grooves or notches or a roughened surface which will help to prevent, during transit of the assembly, lateral movement of the heads of the hangers that might result in one hanger head riding up over the top of adjacent hanger head.

In the embodiment shown in FIGS. 3–5, the assembly can be carried by holding the hanger support rod 12′.

Alternatively, a handle could be provided on the end of the panel 13′.

Although the foregoing invention has been described in some detail by way of illustration and example for purposes of clarity of understanding, it is understood that certain changes and modifications may be practiced within the spirit of the invention as limited only by the scope of the appended claims.

What is claimed is:

1. A complete and independent clothes hanger support and storage assembly for removably supporting a multiplicity of empty conventional clothes hangers having hanger portions including a head and a neck portion and at least first and second arm portions, each arm portion connected at one end to said neck portion, said assembly comprising:

an elongate base support member an upright support member integrally connected to said base support member and projecting upwardly therefrom, an elongate hanger support rod cantilevered and integrally connected from one end to said upright support member and sloping upwardly away from said base support member in the direction along said rod away from said upright support member, said hanger support rod at the end thereof connected to the said upright support member spaced from said base support member by a distance greater than the vertical distance from the head portion to the ends of the arm portions remote from the neck portion of a coat hanger and less than the distance from the head portion to the end of an arm portion, said support rod having a length for holding a multiplicity of coat hangers side by side and free from obstruction of the hanger head portion above said rod, and a hanger retaining member integrally connected to said base support member, spaced to one side of said support member, and spaced closer to said base support member than said hanger support rod, said assembly being free from obstruction above said base support member on the side of said support rod opposite said one side where said hanger retaining member is located, said retaining member laterally spaced from said hanger support rod by a distance less than the lateral distance between the neck of a clothes hanger and the end of an arm portion remote from the hanger neck portion to permit contact of a portion of said retaining member with an arm portion of a hanger hung by its head portion on said hanger support rod, said hanger retaining member along the length therof longitudinally spaced at least closer to said base member than said hanger support rod by a distance equal to or greater than the vertical distance from the top of the hanger head portion to a point on the hanger arm portion spaced laterally from the top of the head by a distance equal to the lateral spacing at said upright support member between the hanger support rod and said contacting portion of said hanger retaining member whereby an arm of an empty clothes hanger with the head portion thereof hooked over said support rod contacts said hanger retaining member when said base support member is supported on a horizontal surface.

* * * * *